United States Patent [19]

Ishikura et al.

[11] Patent Number: 4,570,543

[45] Date of Patent: Feb. 18, 1986

[54] CONVEYING EQUIPMENT

[75] Inventors: Takashi Ishikura; Hisakazu Sakamoto, both of Osaka, Japan

[73] Assignee: Tsubakimoto Chain Co., Osaka, Japan

[21] Appl. No.: 508,678

[22] Filed: Jun. 28, 1983

[30] Foreign Application Priority Data

Jun. 30, 1982 [JP] Japan ..... 57-114368

[51] Int. Cl.[4] ..... B60L 15/40

[52] U.S. Cl. ..... 104/300; 104/93; 104/247; 105/50; 105/150; 246/187 A

[58] Field of Search ..... 104/93, 295, 300, 110, 104/91, 106, 89, 247; 105/50, 51, 148, 150; 246/187 A, 187 B; 455/603

[56] References Cited

U.S. PATENT DOCUMENTS

| | | | |
|---|---|---|---|
| 1,711,401 | 4/1929 | Baldwin et al. | 105/50 |
| 3,041,983 | 7/1962 | Liversidge et al. | 105/150 |
| 3,194,178 | 7/1965 | Weston | 104/93 X |
| 3,244,293 | 4/1966 | Stahmer | 105/50 X |
| 3,625,158 | 12/1971 | Lorenz et al. | 105/150 X |
| 3,842,745 | 10/1974 | Jones | 105/150 X |
| 3,847,085 | 11/1974 | Rypinski | 105/50 X |
| 3,884,437 | 5/1975 | Linderman | 246/187 B X |
| 3,943,357 | 3/1976 | Culver | 455/603 |
| 4,423,685 | 1/1984 | Kerckhoff | 105/150 |

FOREIGN PATENT DOCUMENTS

| | | | |
|---|---|---|---|
| 2712724 | 9/1978 | Fed. Rep. of Germany | 246/187 B |
| 3046201 | 6/1982 | Fed. Rep. of Germany | 246/187 A |
| 190008 | 6/1964 | Sweden | 104/110 |

*Primary Examiner*—Randolph A. Reese

*Attorney, Agent, or Firm*—Burns, Doane, Swecker and Mathis

[57] ABSTRACT

Conveying equipment provided with a conveying vehicle guided by a single overhead rail without the necessity of an auxiliary rail due to the wheel and vehicle body unit construction which enables stable running of the vehicle. The equipment of the invention employs only one rail, thereby being simple in construction and extremely convenient for a non-permanent installation or a conveying equipment whose route is frequently changed, and also made remote-controllable by photo signals in simple operation.

6 Claims, 10 Drawing Figures

CONVEYING EQUIPMENT

BACKGROUND OF THE INVENTION (1) Field of the Invention

This invention relates to an overhead conveying equipment.

(2) Description of the Prior Art

Various conveying equipment has hitherto been put into practice in which a vehicle is hung from an overhead rail and travels therethrough, the overhead rail often employing a monorail due to its simple construction. The monorail construction of the prior art, however, provided an auxiliary rail for preventing sideways swinging or derailment of a conveying vehicle, thereby being large-scaled. Therefore, in a case of using such construction in a shop, where the layout of equipment is often changed, the problem exists in that it takes much time to change the conveying route.

It is more difficult for a monorail provided with a feed line to change the conveying route. Battery operated equipment requires no feeder line, but has a problem in that exchange or charging of batteries is troublesome.

Remote control is desired to operate the vehicle to travel or stop, but in a case of using electric waves as the communication medium, various electric circuits in the shop are subjected to interference, whereas when light or infrared is to be used as the communication medium, signals cannot be transmitted when the light receiving unit that is usually provided on the vehicle enters into the dead angle, thereby being restricted in use within the shop if there are many obstacles to the light.

This kind of equipment often allows the conveying vehicle to move or stop as predetermined, such as reciprocation between the predetermined points or a stop at the station, other than the above remote control. In this case, a switch dog complicated in construction and of high accuracy has conventionally been used for the assignment of position, which has the problem of taking too much time to adjust or change its mounting position.

OBJECTS OF THE INVENTION

In the light of the above problems, this invention has been designed.

A first object of the invention is to provide a conveying equipment simple in construction, using only one rail and being easy to install or dismantle, thereby being useful for a conveying line where such is subject to being changed frequently.

A second object of the invention is to provide a conveying line along which a conveying vehicle stably and smoothly travels even when the conveying route is curved as well as straight.

A third object of the invention is to provide conveying equipment easy to set or change stations or turning points.

A fourth object of the invention is to provide conveying equipment whose batteries serving as a power source, after discharged, can be charged without dismounted from the vehicle while being kept hung on the rail.

A fifth object of the invention is to provide conveying equipment provided with remote control capable of easy operation.

The above and further objects and features of the invention will more fully be apparent from the following detailed description with accompanying drawings.

DETAILED DESCRIPTION OF THE INVENTION

Figure 1:
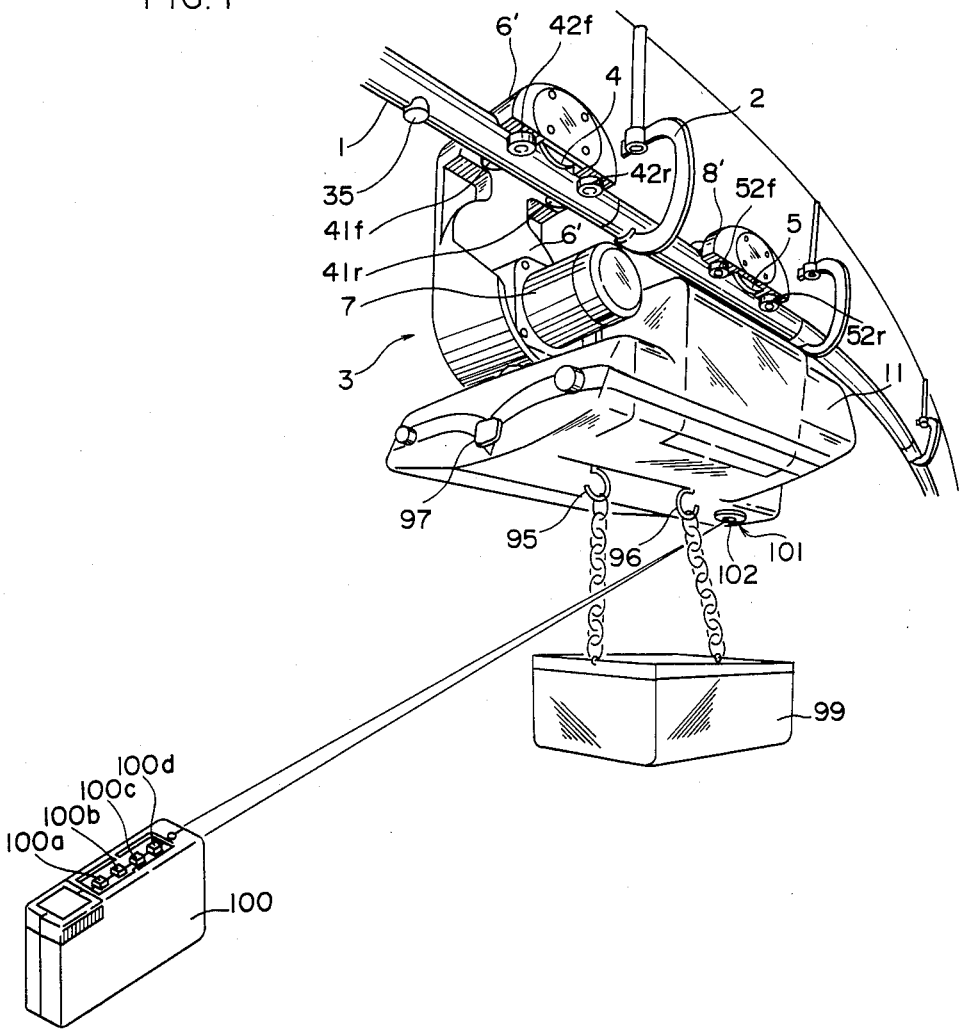
FIG. 1 is a perspective view of an embodiment of an overhead conveyor of the invention, when viewed from below.
Figure 2:
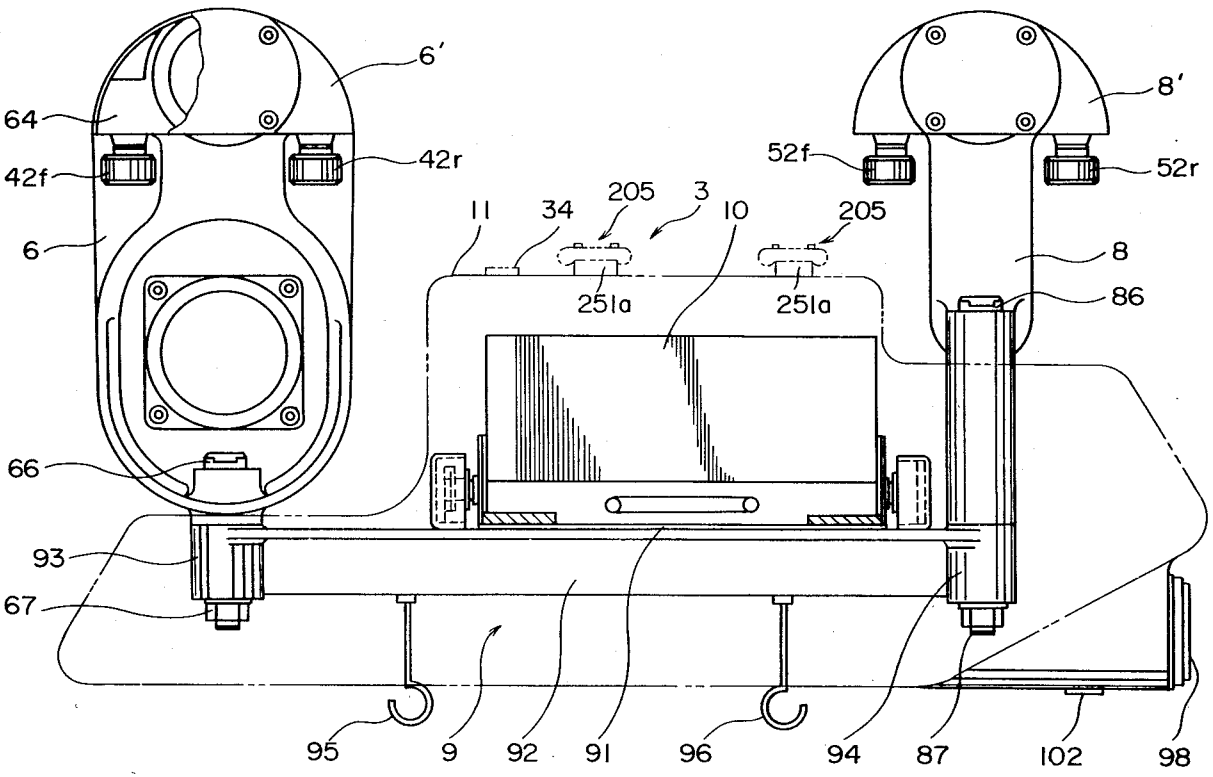
FIG. 2 is a side view of the conveyor.
Figure 3:
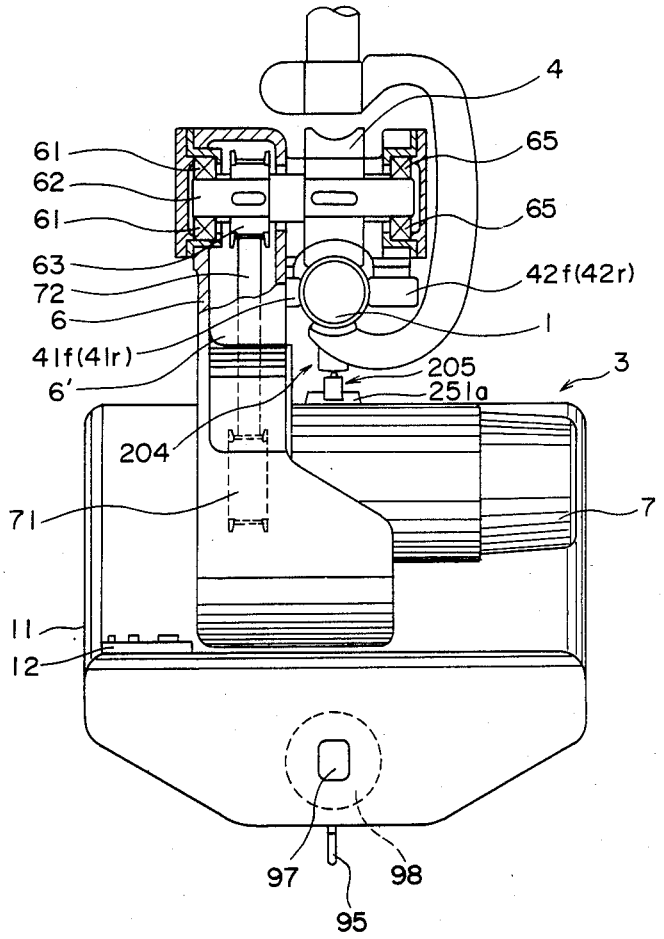
FIG. 3 is a front view of the same.

Referring to FIGS. 1, 2 and 3, a rail 1 of round pipe is supported to an overhead structure, such as a ceiling or a girder through a number of supporting members 2 of about C-like shape as shown. The supporting members 2 all are positioned at one side of rail 1 so as not to hinder movement of conveying vehicle 3, and are joined to the lower peripheral surface of rail 1 to thereby rigidly fix it. Alternatively, the supporting members 2 may extend downwardly from the rail 1 and support it from below.

The conveying vehicle 3 hung on the rail 1 comprises front and rear wheel units and a vehicle body connecting them, suspended from the rail 1. The arrangement and configuration of wheels are important for the elimination of the axiliary rail conventionally used for anti-swing, to ensure stable running of vehicle 3 through the single rail 1.

Figure 4:
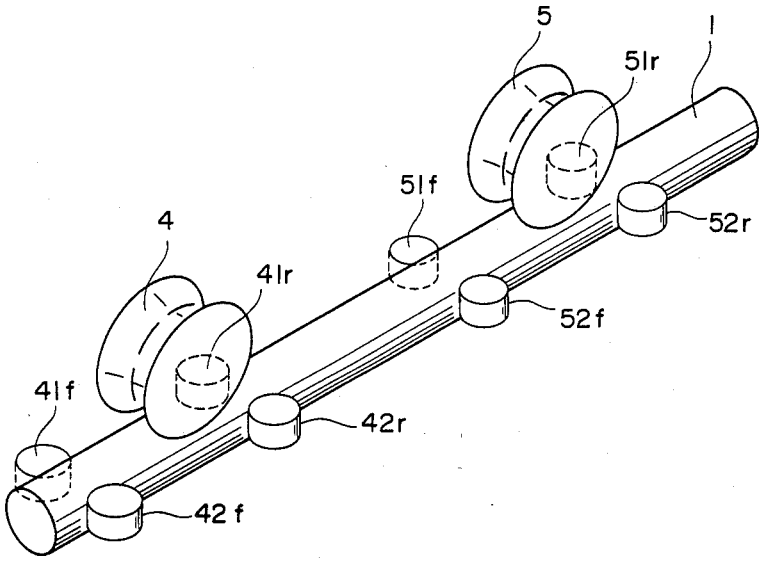
FIG. 4 is a view illustrating wheels of the conveying vehicle.

FIG. 4 shows the arrangement and configuration of each wheel of the vehicle 3, in which main wheels 4 and 5, each having an hour-glass-like shape, rotatably contact the upper side of rail 1. Subwheels 41*f*, 42*f*, 51*f* and 52*f*; 41*r*, 42*r*, 51*r* and 52*r*, each of short columnar shape, are positioned in front (or at the rear) of each main wheel 4 or 5 and rotatably contact both lateral sides of rail 1, respectively, the front main wheel 4 being called the driving wheel and the rear wheel 5, the driven wheel in this embodiment. The respective wheels are made from, for example, rubber or synthetic resin, and main wheels 4 and 5 are in close contact with the rail 1 by the load applied to the vehicle 3, but the right sub-wheels (41*f* through 52*f* and 41*r* through 52*r*) for preventing the swinging motion are adapted to contact the rail 1 with some clearance in consideration of the curvature of the curved rail 1. In addition, pairs of sub-wheels 41*f* and 42*f*, 41*r* and 42*r*, 51*f* and 52*f*, and 51*r* and 52*r*, opposite to each other at both sides of rail 1 are symmetrical with respect to the center thereof, the front and rear sub-wheels 41*f* and 41*r*, 42*f* and 42*r*, with respect to the main wheel 4 and sub-wheels 51*f* and 51*r*, and 52*f* and 52*r* to the main wheel 5, are positioned at equidistances away from the main wheels 4 and 5 respectively.

A wheel shaft 62 (FIG. 3) is supported at its base end horizontally through a bearing 61 to the center of upper end of a front wheel shaft bearing member 6. Carried at the base end side is a pulley 63 and at the fore end side the main wheel 4 is keyed thereto. A wheel shaft mounting frame 64 (FIG. 2) is formed at the upper portion of wheel shaft bearing member 6 in a manner such as to enclose the wheel shaft 62 and main wheel 4; the wheel shaft 62 being supported at the outer foremost end thereof through a bearing 65 to the portion of frame 64 opposite to the wheel shaft bearing member 6. The wheel shaft mounting frame 64 is provided with vertical spindles through which the sub-wheels 41*f*, 42*f*, 41*r* and 42*r* are rotatably supported.

To the lower portion of wheel shaft bearing member 6 is mounted an electric motor 7 so that its rotary shaft extends in parallel to the wheel shaft 62; the rotary shaft is positioned beneath bearing member 6. The motor 7 rotatably drives a pulley 71 through reduction gears (not shown). Pulleys 71 and 63 both are toothed and a cogged belt 72 is carried across the pulleys 71 and 63, the main wheel 4 being rotatably driven by the motor 7 through the belt 72.

The wheel shaft bearing member 8 at the rear side is simple in construction because a motor need not be provided. The main wheel 5 is keyed to a wheel shaft rotatable and parallel to the wheel shaft 62 and the sub-wheels 51*f*, 52*f*, 51*r* and 52*r* are rotatably supported to vertical spindles provided about rear main wheel shaft bearing member 8 and positioned below the main wheel 5. The main wheels 4 and 5 and belt 72 are shown covered by ornamental covers 6' and 8' for dust-proofing.

Shafts 66 and 86 extend vertically downwardly from the lower portions of wheel shaft bearing members 6 and 8 and are connected at their lower end portions to a loading beam 9 in relation of being rotatable in association with the shafts 66 and 86, the loading beam 9 extending between the front and rear wheel units and supporting a hanging load. Nuts 67 and 87 are screwed onto the lower ends of shaft 66 and 86 respectively, thereby locking the loading beam 9. The loading beam 9 is positioned just below the centers of main wheels 4 and 5 with respect to the wheel shaft bearing members 6 and 8 respectively.

The loading beam 9 comprises a horizontal portion 91 of suitable width and one or more vertical portions 92 for reinforcement of horizontal portion 91, and is provided at both lengthwise ends with tubular portions 93 and 94 fitted onto the shafts 66 and 86 respectively. The vertical portions 92 support slings 95 and 96. The horizontal portion 91 is provided with an appropriate bracket on which batteries are detachably loaded. Also, a cover 11 is mounted to the loading beam 9 by use of a supporting member (not shown) and covers the batteries 10 and an electric circuit (in FIG. 7) to be discussed below; a control board 12 being mounted to the cover 11 at the left side in FIG. 2.

At the front of cover 11 is mounted a photo switch 97 (FIG. 1) of regressive reflected light detection type provided with a light-emitting and sensor eye, and to the rear of the same is stuck a reflector 98 (FIG. 2) used for a photo switch of another conveying vehicle.

Also, at the lower surface of cover 11 is mounted a photo sensor 101 which keeps a sensor eye 102 facing downwardly, and at the upper surface of the same is mounted a reed switch 34 in the position facing the lower surface of rail 1. A remote control unit 100 is provided to generate infrared ray signals corresponding to the contents of operation. Furthermore, the cover 11 is provided at the upper surface with recesses so as not to hinder the wheel shaft bearing members 6 and 8 and ornamental covers 6' and 8' from rotation. At the lower surface bores are provided through which the slings 95 and 96 are inserted, the slings 95 and 96 being used for hanging a load container 99. The conveying vehicle 3 constructed as above mentioned arranges the components so as to keep the center of gravity of vehicle 3 on the plane including the center of the axial direction of the respective main wheels 4 and 5.

Figure 5:
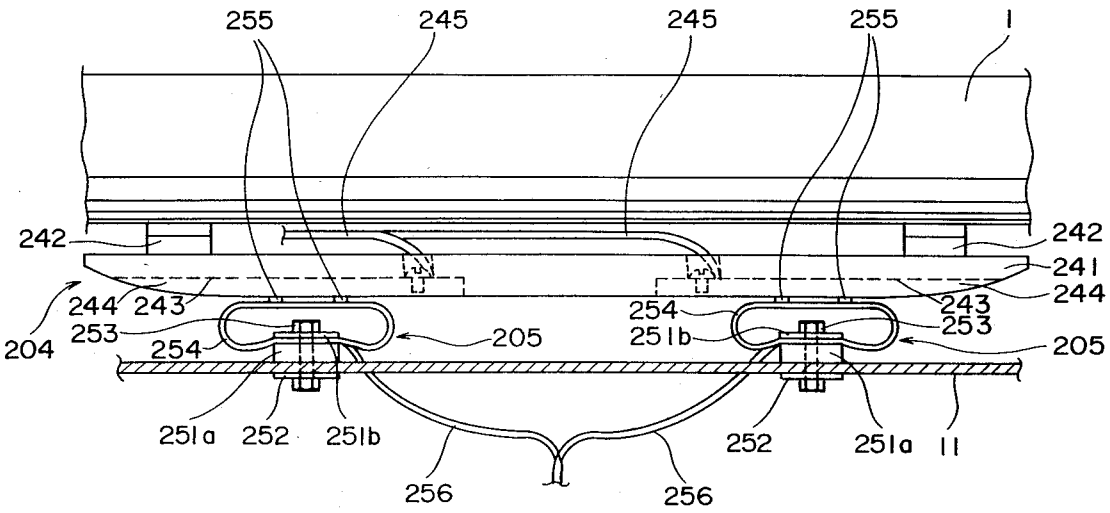
FIG. 5 is a side view of a feeder and collectors.
Figure 6:
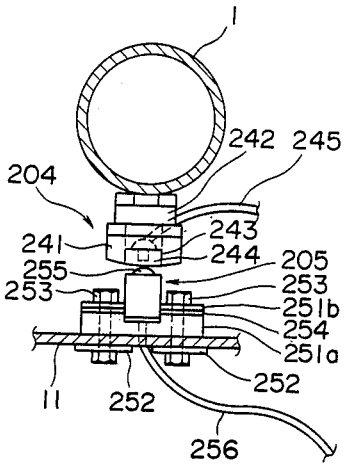
FIG. 6 is a front view of the feeder and collectors.

At a predetermined position on rail 1 is provided a station for charging the secondary cells, i.e., the rechargeable batteries 10, which station may be exclusive for charging, or utilize a loading and unloading point or a stand-by point for a branch of rail 1; the station providing a feeder 204 as shown in FIGS. 5 and 6 and the vehicle 3 carrying collectors 205 in slidable contact with the feeder 204.

At first, explanation will be given on the feeder 204. Referring to FIG. 5, a base plate 241 of insulating material, such as synthetic resin, is rounded at both ends in the moving direction of vehicle 3, sledge-like-shaped when viewed from the side as shown, curved in a circular arc at both lateral sides, and is about half the length of vehicle 3. Magnets 242 are fixed to the upper surface of base plate 241 at both lengthwise ends thereof, by which the feeder 204 is magnetically stationary at the lower surface of rail 1 at the station position. Grooves 243 each of proper depth and proper width are formed at the lower surface of base plate 241 and positioned near both lengthwise ends thereof and at the widthwise centers of the same, so that feeder electrodes 244 of brass are fixedly fitted into the grooves 243 so as to be level with the lower surface of base plate 241. Also, the base plate 241 has at its upper surface bores extending to the electrodes 244, through which bores lead wires 245 are connected to the electrodes 244.

The collectors 205 are bolted on the upper surface of cover 11 at the portions thereof just below the rail 1 and spaced longitudinally of cover 11 at a distance about equal to the distance between the centers of feeder electrodes 244. At each collector mounting portion, a clamp of brass comprising a thick rectangular base 251*a* and a flat holder 251*b* to thereby fixedly sandwich therebetween an elastic member 254 serving as the collector 205 abuts against the upper surface of cover 11. A metal fitting 252 abuts against the inner surface of the same, and a threaded bolt 253 is inserted through bores formed at the clamp. Cover 11 and fitting 252 are tightened by a nut from inside cover 11, thereby fixing each collector 205. Each elastic member 254 is formed of a flat elliptical plate of phosphor bronze, bent downwardly at both ends in the major axis direction, and fixedly attached at both ends by the clamp, and has at the top contact members 255 fixed thereto. Each clamp is divided vertically into two parts having therebetween one end of lead wire 256.

Figure 7:
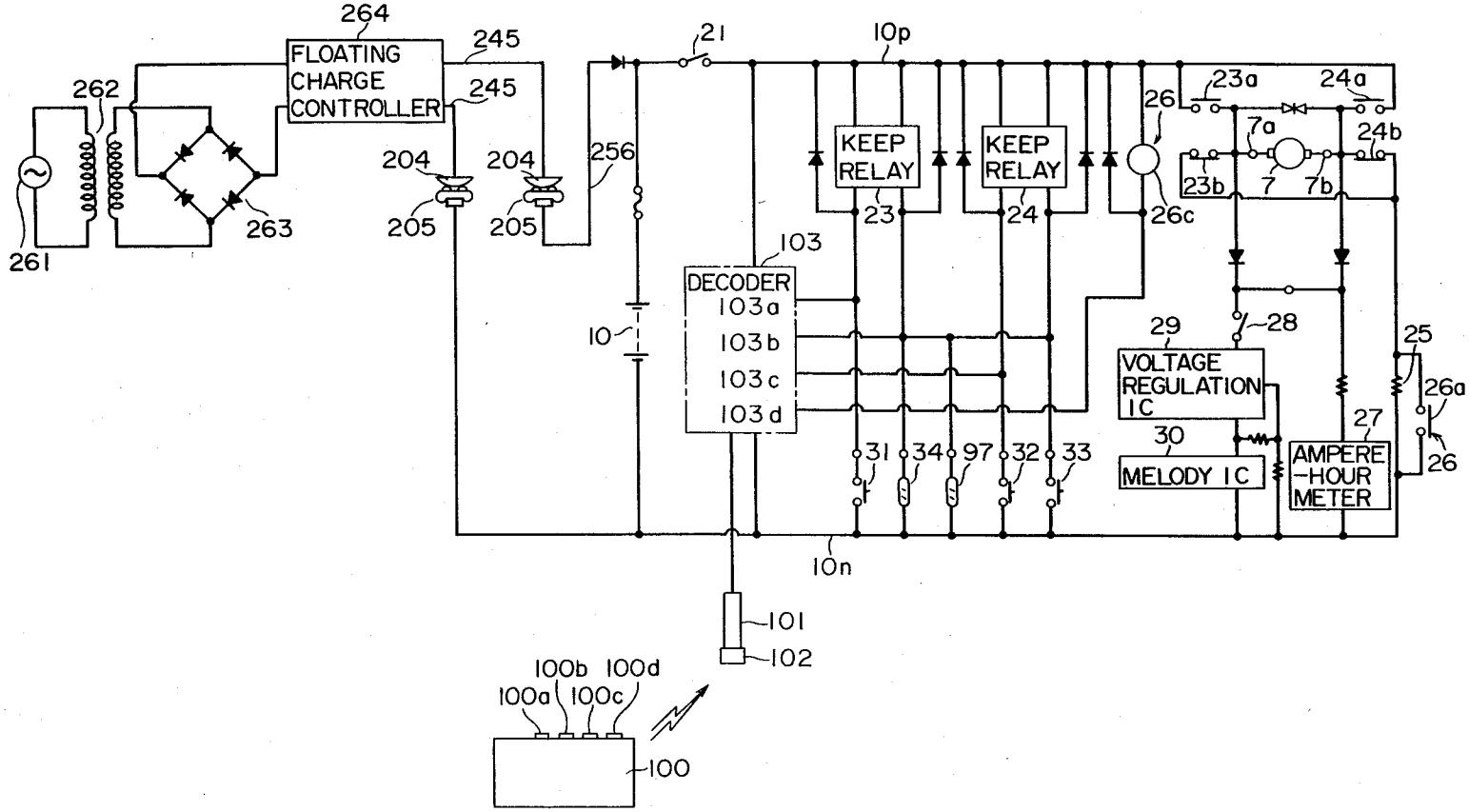
FIG. 7 is a circuit diagram of an electric circuit of the invention.

Referring to FIG. 7, an electric circuit of the invention is shown, in which the positive electrode of batteries 10 connects with a positive line 10*p* through a main switch 21 and the negative electrode of the same with a negative line 10*n*; the positive electrode also connecting with one lead wire 256 through a diode having the cathode at the positive electrode side for preventing a dead-short-circuit; the negative electrode of batteries 10 connected direct to the other lead wire 256.

Reference numeral 261 designates a commercial power source, the power from which is dropped to desired voltage by a transformer 262, the secondary low voltage thereof being fed to a rectifier 263, and thence to the feeders 204 from the lead wires 245 through a floating charge controller 264.

Between the positive line 10*p* and the negative line 10*n* are connected a series circuit of normally open contact 23*a* of a keep relay 23, the electric motor 7, a normally closed contact 24*b* of a keep relay 24, and resistance 25 for speed reduction; both the contacts 23*a* and 24*b* being closed to provide the connection to normally power the motor 7. A normally closed contact 23*b* of keep relay 23 is connected between the node of contact 23*a* and of a first terminal 7*a* of motor 7 and the node of contact 24*b* and resistance 25, and a normally open contact 24*a* of keep relay 24 is connected between the node of contact 24*b* and of a second terminal 7*b* of motor 7 and the positive line 10*p*, the contacts 24*a* and 23*b* closing to provide the connection to reverse the polarity of the motor 7. The resistance 25 connects in parallel with a normally open contact 26*a* of an electromagnetic relay 26 and is adapted to be closed to power the motor 7 at high speed. A series circuit of a diode, resistance and an ampere-hour meter 27, is connected between the second terminal 7*b* of motor 7 and the negative line 10*n*; the ampere-hour meter 27 being mounted visibly to the control board 12 so as to display a number corresponding to the product of an exciting current (an exciting current for motor 7 in this embodiment) and a current-carrying time; the meter 27 itself being the well-known element. A series circuit of a diode, a switch 28, a voltage regulator IC 29, and a melody IC 30, is provided between the first terminal 7*a* of motor 7 and the negative line 10*n*, so that when the switch 28 is closed and the motor 7 is energized, the melody IC 30 generates a predetermined melody to signify the running of vehicle 3.

The keep relays 23 and 24 are connected with the positive line 10*p*, push button switches 31 and 32 for selecting the normal or reverse mode of motor 7, and a push button switch 33 for stopping vehicle 3. A reed switch 34 and an photo switch 97, are connected to release signal terminals of the same; these switches 31, 32, 33 and 34 being connected at both ends to the negative line 10*n*, and also being mounted on the control board 12.

The remote control unit 100, the photo sensor 101 and a decoder 103, employ INFRAFERN (trade name) FSE541 manufactured by Siemens Co. in West Germany. The remote control unit 100 is provided with four push button switches 100*a*, 100*b*, 100*c* and 100*d* to thereby generate 2-phase code signals in the infrared band corresponding to operation of each button switch. The photo sensor 101 receives the infrared signals through the photo sensor unit comprising a lens and a photodiode, so that the signals are photoelectrically converted and then given to a decoder 103. The decoder 103 is interposed between the positive line 10*p* and the negative line 10*n* and reads input signals from the photo sensor 101 to allow each output terminal 103*a*, 103*b*, 103*c* or 103*d* at the decoder 103 to have a low level (the level of negative line 10*n*) corresponding to operation of each switch 100*a*, 100*b*, 100*c* and 100*d*. The output terminals 103*a* and 103*c* are connected to the terminals of keep relays 23 and 24 respectively. The output terminal 103*b* is connected to the terminals of keep relays 23 and 24, and the output terminal 103*d* is connected to the positive line 10*p* through an exciting coil 26*c* at an electromagnetic relay 26.

The conveying equipment of the invention, constructed as abovementioned, is used by keeping the vehicle 3 suspended from the rail 1 and hanging a load container 99 from the slings 95 and 96. In the state where the main switch 21 is closed, when the switch 31 or 32 is pushed, the keep relay 23 or 24 keeps its actuating condition. The contacts 23*a* and 24*b*, or 24*a* and 23*b*, are closed for normal or reverse operation of the motor 7, and the vehicle 3 moves forwardly or rearwardly, during which time the melody IC 30 gives a melody alarm and the ampere-hour meter 27 carries out the timing by the energized motor 7 to thereby display the operating time. The switch 33 is pushed to release the keep relay 23 or 24 from actuating condition, and the contact 23*a* or 24*a* is open to stop the rotation of motor 7 and in turn the running of vehicle 3. In a case where the vehicle 3 is intended to stop at a particular position on the rail installation route, a permanent magnet 35, as shown in FIG. 1, is previously mounted to the lower peripheral surface of rail 1 by use of suitable means. Then, the reed switch 34 mounted on the upper surface of cover 11 operates (closes) upon arriving just below the permanent magnet 35, so that the keep relays 23 and 24 are released to stop the operation of motor 7. In a case where a plurality of conveying vehicles 3 are suspended from the rail 1 (in this case, the vehicles 3 usually are movable forward only), the light emitted from the photo switch 97 at one vehicle 3 is reflected by the reflector 98 at another vehicle ahead of the one vehicle 3 and detected by the photo switch 97, which is actuated to stop the motor 7, thereby avoiding a rear-end collision between the two vehicles 3.

On the other hand, in the case of operating the remote control unit 100, the switch 100*a* or 100*c* is actuated to allow the output terminal 103*a* or 103*c* at the decoder 103 to have a low level so that the keep relay 23 or 24 is put in operating condition and the motor 7 operates normally or reversely, thus moving the vehicle 3 forwardly or backwardly. During this time, upon actuating the switch 100*d*, the decoder output terminal 103*d* has a low level and an exciting coil 26*c* is energized to close the contact 26*a* and the resistance 25 is bypassed. Hence, the motor 7 increases the speed to allow the vehicle 3 to run at high speed. Upon actuating the switch 100*b*, the decoder output terminal 103*b* has a low level so that the keep relay 23 or 24 is released from actuating condition and stops the motor 7.

During the use of remote control unit 100, its infrared ray emitting unit is preferably operated facing the sensor eye 102 provided at the lower surface of cover 11. The infrared rays reflected from any direction being readily received by the sensor eye 102, provided as the above. When the conveying equipment of the invention is used indoors, the remote control unit 100, when in an operable range defined by the specifications of the unit 100 and photo sensor 101, is operable without regard to the infrared ray projecting direction. While, even when in outdoor use, in a case of surrounding the rail 1 by walls or the like, the remote control unit 100 is operable regardless of any projecting direction of the light because the reflected light from the wall, the floor or the ground, can be sensed. Also, in a case where the light of moderate intensity is expected to be reflected from the floor or ground even if no reflective structures are present, the remote control is performable by projecting the light toward the vehicle 3 or the floor or ground at an intermediate position between an operator and the vehicle 3.

The reason such effect is obtained is that in the case of providing the sensor eye 102 as the invention, its visual field covers an about hemispheric range below and around the vertical, resulting in the state where the reflected light from the surrounding structures is sensed with ease. The conventional vehicle having mounted a photo sensor on the side thereof, when compared with the invention, cannot sense the reflected light from the rear (the reverse side), and includes in the visual field, in part, the upper range where the reflected light is less than that in the lower range, which is useless. Also, the sensor eye 102, when provided at the upper surface of cover 11 at the vehicle 3, the upper visual field is useless to reduce an effective visual field. Hence, the provision of sensor eye 102 as the invention is the most effective.

In addition, it is a matter of course that expansion of the light beam projected from the remote control unit 100 contributes to attain the above effect.

Also, the light sensor unit of the invention need not always be mounted to the lowermost portion of vehicle 3 and face vertically downwardly, but may, if necessary be mounted so as to slightly slant the optical axis of the same. Alternatively, a lens of light sensor of the invention may include an end face of optical fibers whose other ends thereof may be mounted to the photoelectric conversion element.

Now, explanation will be given on operation of wheels at the vehicle 3 during its running. The right-hand and left-hand sub-wheels, when the vehicle 3 runs along the straight rail 1, roll in properly rotatable contact with the lateral peripheries of rail 1 to restrict the laterally swinging motion of vehicle 3. The loading beam 9 at a curved portion of rail 1 is positioned in the mode of being a chord to the arc and the wheel shaft bearing members 6 and 8 turn around the tubular portions 93 and 94 of the loading beam 9, at which time each sub-wheel is subjected to lateral pressure to thereby be pressed into contact with the rail 1 due to its curve, thus reducing the speed of wheel of itself and strengthening its engagement with the rail 1 to increase the safety in the vehicle's running.

Alternatively, the rail 1 may employ a pipe square in section. In this case, the main wheels 4 and 5 in contact with the upper surface of rail 1 need only be columnar-shaped similarly to the sub-wheels, which is as effective as when using round pipe.

Also, the container 99 hung from the loading beam 9 may alternatively be replaced by a box provided with a trailer connection to the wheel shaft bearing member 8, cover 11 or loading beam 9 and driven along the rail 1 for conveying loads. In this case, a plurality of trailers may of course be connected for use, the loading beam 9 may be provided with a gripper or the like for carrying objects, or the cover 11 itself may provide a space for containing the object to be conveyed.

Now, after repeating the vehicle's running as the above, the voltage of batteries 10 drops to make impossible the running at a desired speed, the vehicle 3 is stopped at the station where the feeder 204 is mounted to the rail 1, so that the contacts 255 at the collectors 205 are brought into contact with the electrodes 244, 244 of the feeder 204, and then the power source 61 or floating charge controller 264 starts to charge the batteries 10.

During the above charging, the control circuit for the motor 7 is energized by the batteries 10 to enable control of motor 7, such as keeping it to a halt, and also the vehicle 3 can travel from the station by the remote control. Furthermore, a hoisting means other than the motor 7, when provided at the vehicle 3, can be driven by the batteries 10. In brief, the advantage of floating charge can be given. In addition, the pair of feeders 204 and collectors 205 may alternatively be juxtaposed laterally of vehicle 3.

Also, since the feeder 204 is attached to the rail 1 by means of magnets 242, the station is easy to move.

Figure 8:
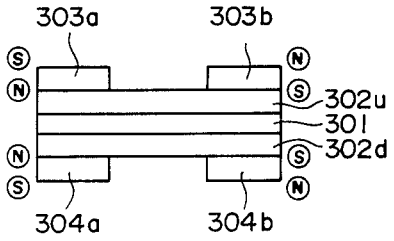
FIG. 8 is a schematic front view of an exemplary magnet unit.
Figure 9:
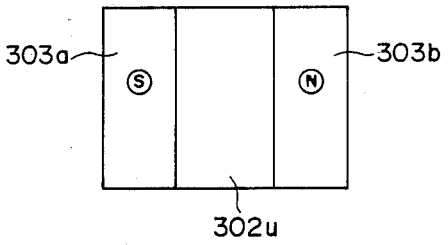
FIG. 9 is a plan view thereof.
Figure 10:
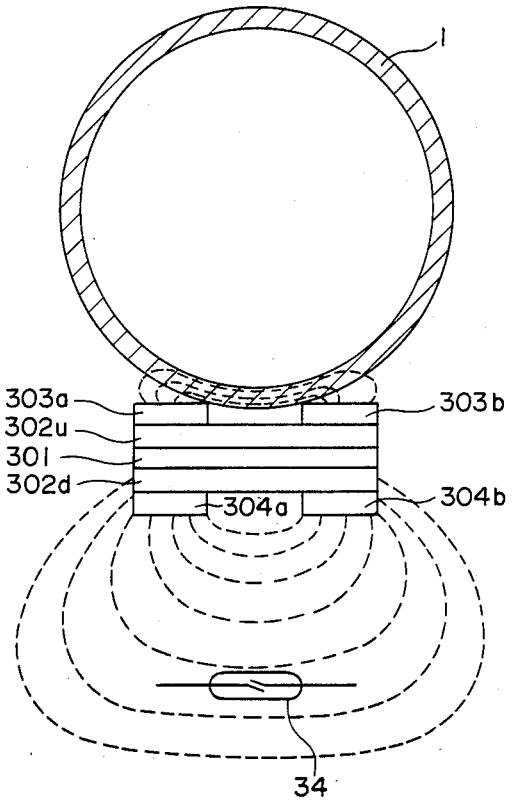
FIG. 10 is a front view of the magnet unit mounted on a rail.

Next, explanation will be given on the magnet 35 used to set the station for battery charging or other operations, at the position where the vehicle 3 is stopped. The magnet 35 may be bolted to the lower side of rail 1, but when mounted as discussed below, is readily and quickly changeable from its set position. In detail, referring to FIGS. 8, 9 and 10, reference numeral 301 designates a spacer, 302*u* and 302*d* designate iron plates, and 303*a*, 303*b*, 304*a* and 304*b* designate permanent magnets respectively. The spacer 301 is formed of a rectangular plate of non-magnetic material, such as plastic or the like, the iron plates 302*u* and 302*d* being rectangular and equal in the size to the spacer 301 and fixed integrally thereto in a manner of sandwiching the spacer 301 between the plates 302*u* and 302*d* by use of adhesives. The permanent magnets 303*a*, 303*b*, 304*a* and 304*b* each are of equal size, have a length equal to width of each plate 302*u* or 302*d*, a width smaller than length thereof, and a thickness equal to that of the same. The N-pole is at the upper or lower half and the S-pole at the lower or upper half as shown. The magnets are fixed by use of adhesives integrally to the upper surface of plate 302*u* and the lower surface of plate 302*d* at the leftward and rightward ends thereof and spaced from each other a proper distance. The magnet 303*a* of the upper S-pole and lower N-pole and 303*b* of the upper N-pole and lower S-pole are fixed to the upper surface of plate 302*u*, and 304*a* of the upper S-pole and lower N-pole, and 304*b* of the upper N-pole and lower S-pole, are fixed to the lower surface of plate 302*d*, so that the adjacent magnets 303*a* and 303*b*, 304*a* and 304*b*, are fixed to the plates 302*u* and 302*d* in an opposed polar relationship. Now, for example, where the magnets 303*a* and 303*b* at the upper surface of plate 302*u* are magnetically attached to the lower surface of rail 1 as shown in FIG. 10, the magnetic lines of force are as shown by the broken lines. In other words, the magnetic lines of force produced between the N-poles and the S-poles at the upper and lower surfaces of both the magnets 303*a* and 303*b* on the upper surface of plate 302*u* are within the plate 302*u* and rail 1 functioning as the yoke, thereby causing no leakage of flux on the way. On the other hand, the magnetic lines of force generated between the N-pole and the S-pole at the upper sides of magnets 304*a* and 304*b* disposed within the moving zone of reed switch 34 and the plate 302*d* functions as the yoke not to produce leakage flux. Hence, the magnetic lines of force between the N-pole and the S-pole at the lower side are produced widely downwardly and longitudinally of rail 1 so that the reed switch 34 is reliably actuated when it reaches the magnet unit, thus obtaining stable operation.

As this invention may be embodied in several forms without departing from the spirit of essential characteristics thereof, the present embodiment is therefore to be regarded as illustrative and not restrictive, the scope of the invention being defined by the appended claims rather than by the description preceeding them, and all changes that fall within the metes and bounds of the claims, or equivalence of such metes and bounds are therefor intended to be embraced by the claims.

What is claimed is:

1. A conveying apparatus comprising a single overhead rail and a conveying vehicle;

said single overhead rail having a round periphery and having a substantially uniform cross-sectional configuration throughout its length, said cross-sectional configuration having a height in a vertical direction and a width in a horizontal direction, the width of the cross-sectional configuration being at a maximum at a mid-point of the height;

said vehicle comprising two main wheels which contact the rail at its upper periphery and which are rotatable and spaced apart in a moving direction of the vehicle, a wheel shaft bearing member provided for each main wheel, pairs of subwheels are provided on each side of the rail and in contact with the rail at its maximum width, each pair having a rotatable subwheel on each side of a main wheel in the moving direction;

an electric motor for driving at least one of the main wheels, an electrical circuit for controlling operation of said motor, batteries for providing a power source for said motor and means for supporting a hanging load rotatably connected to each wheel shaft bearing member.

2. A conveying apparatus as set forth in claim 1, wherein said electrical circuit is provided with a reed switch disposed at an upper portion of said conveying vehicle and magnets for actuating said reed switch are attached to said overhead rail.

3. A conveying apparatus as set forth in claim 2, wherein said magnets are attached to said overhead rail by use of other magnets.

4. A conveying apparatus as set forth in claim 1, wherein said batteries are rechargeable batteries.

5. A conveying apparatus as set forth in claim 4, wherein said rail is provided with a feeder, said conveying vehicle being provided with a collector contactable with said feeder, so that said rechargeable batteries are adapted to be charged through said feeder and collector.

6. A conveying apparatus as set forth in claim 1, and further including an optical remote control unit, a photo sensor which receives a photo signal generated by said remote control unit and photo-electrically converts said signal, and said electrical circuit for controlling operation of said motor is operatively connected to said converted signal from said photo sensor to process said converted signal, said photo sensor having its sensor eye positioned at a bottom side of said conveying vehicle.

* * * * *